US008898836B1

(12) United States Patent
Puri et al.

(10) Patent No.: US 8,898,836 B1
(45) Date of Patent: Dec. 2, 2014

(54) SELF LEVELING CADDY

(71) Applicants: Kathleen F. Puri, Chattanooga, TN (US); Caroline F. Puri, New York, NY (US); John C. Ekholm, Chicago, IL (US)

(72) Inventors: Kathleen F. Puri, Chattanooga, TN (US); Caroline F. Puri, New York, NY (US); John C. Ekholm, Chicago, IL (US)

(73) Assignee: Fitsi Health, LLC, Chattanooga, TN (US)

( * ) Notice: Subject to any disclaimer, the term of this patent is extended or adjusted under 35 U.S.C. 154(b) by 25 days.

(21) Appl. No.: 13/940,340

(22) Filed: Jul. 12, 2013

Related U.S. Application Data

(60) Provisional application No. 61/671,549, filed on Jul. 13, 2012.

(51) Int. Cl.
*A47B 23/02* (2006.01)
*A61G 7/05* (2006.01)

(52) U.S. Cl.
CPC ..... *A61G 7/0503* (2013.01)
USPC ..... 5/503.1; 5/658; 5/507.1; 248/311.2; 248/302

(58) Field of Classification Search
USPC ..... 5/503.1, 507.1, 658, 424; 248/311.2, 248/302, 309.1
See application file for complete search history.

(56) References Cited

U.S. PATENT DOCUMENTS

| | | | | |
|---|---|---|---|---|
| 3,967,666 | A | 7/1976 | Farrar | |
| 4,431,154 | A | 2/1984 | Hamm | |
| 4,504,992 | A | 3/1985 | Herron et al. | |
| 5,370,246 | A | 12/1994 | Traynor | |
| 5,447,237 | A | 9/1995 | Carter et al. | |
| 5,651,152 | A | 7/1997 | Ritchie et al. | |
| D420,510 | S | 2/2000 | Rotan | |
| 6,148,459 | A | 11/2000 | Verhulst | |
| 6,253,399 | B1 | 7/2001 | Wagner | |
| 6,292,963 | B1 | 9/2001 | Couture | |
| D522,750 | S | 6/2006 | Girod | |
| D636,997 | S | 5/2011 | DeVoe | |
| 8,033,518 | B2 * | 10/2011 | Schuchman | 248/311.2 |
| D656,317 | S | 3/2012 | Baas et al. | |
| 8,136,957 | B1 | 3/2012 | Balcarran | |
| 2009/0014622 | A1 * | 1/2009 | Merritt et al. | 248/689 |
| 2010/0084531 | A1 * | 4/2010 | Schuchman | 248/311.2 |
| 2013/0181490 | A1 * | 7/2013 | Lin | 297/145 |

* cited by examiner

*Primary Examiner* — Brittany Wilson
(74) *Attorney, Agent, or Firm* — Stephen J. Stark; Miller & Martin PLLC

(57) ABSTRACT

A caddy for use with hospital staff or patients provides a rigid housing having a carriage with at least one vertically and, preferably, at least one horizontally accessible compartments. The housing provides a semi-circular opening above the carriage to act as a handle while also, for many embodiments, a back to which a pivot connects to a connector which connects to a hospital bed rail to maintain the caddy in a pre-determined relationship while the rail is angled relative to a horizontal surface.

19 Claims, 5 Drawing Sheets

SELF LEVELING CADDY

CLAIM OF PRIORITY

This application claims the benefit of U.S. Provisional Patent Application No. 61/671,549 filed Jul. 12, 2012, which is incorporated herein by reference in its entirety.

BACKGROUND OF THE INVENTION

Numerous parties have developed travel caddy constructions for various purposes. Design Pat. No. D656,317 shows a construction that could be hung over a door or a rail. Other devices, such as D522,750 and D420,510 appear to be more narrowly directed to use with a hospital bed rail.

Other, more durable caddy structures have also been utilized with hospital bed rails such as U.S. Pat. Nos. 4,504,992, 6,253,399 and 5,651,152.

However, the applicant is unaware of any attempt to make any of these devices where they are self leveling. Specifically, hospital beds normally raise and lower the head and torso of a patient relative to their legs so they can sit up. For the prior art caddy structures, articles on them might tend to slide off onto the floor or fall out when at an angle to the horizontal.

Additionally, while some have handles such as U.S. Pat. No. 5,447,237, none are known to have a convenient construction taking advantage of their shape for aesthetics and possibly balance as well.

SUMMARY OF THE INVENTION

It is a present object of many embodiments of the present invention to provide a hospital caddy for use by patients and/or medical personnel to store items alongside of a hospital bed.

It is a present object of many embodiments of the present invention to provide a hospital caddy for use by patients and/or medical personnel to provide a self-leveling caddy which can maintain a predetermined relationship to horizontal regardless of the angle of the bed rail to which the caddy is attached.

It is a present object of many embodiments of the present invention to provide a hospital caddy for use by patients and/or medical personnel to provide a caddy which can be easily removed from hospital bed rails and sat on a horizontal surface in a horizontal configuration.

It is a present object of many embodiments of the present invention to provide a hospital caddy for use by patients and/or medical personnel to provide a rigid storage device having multiple storage compartments in close proximity to a patient for various uses.

Accordingly, in accordance with a presently preferred embodiment of the present invention, an improved storage device is provided in which an outer housing provides a semi-circular handle about a portion of a carriage which holds items at least partially therein. Some items can be held in a vertical arrangement and some in a horizontal arrangement for at least some embodiments in rigid compartments in the carriage. The carriage may have a round or flat bottom which has been found helpful for some embodiments to provide an ability to stand easily when not attached to a hospital bed rail.

For many embodiments, a back of the carriage has a self-leveling connector or hook which connects to a bed rail and is rotatably connected to the carriage so that as the bed rail is angled the carriage remains in a horizontal configuration with the compartments remaining in a desired orientation to at least attempt to prevent articles from falling out or being difficult to access. The connector may connect via a pivot to the carriage.

Many embodiments may have a multi-piece carriage which allows for a cover over at least some of the compartment space.

The compartments may take on various forms, whether to hold an anti-microbial hand gel or hand sanitizer, a toothbrush and/or toothpaste, cell phone, note pad, exercise band, lip balm, lotion or possibly storage for such items as glasses, combs, etc.

BRIEF DESCRIPTION OF DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
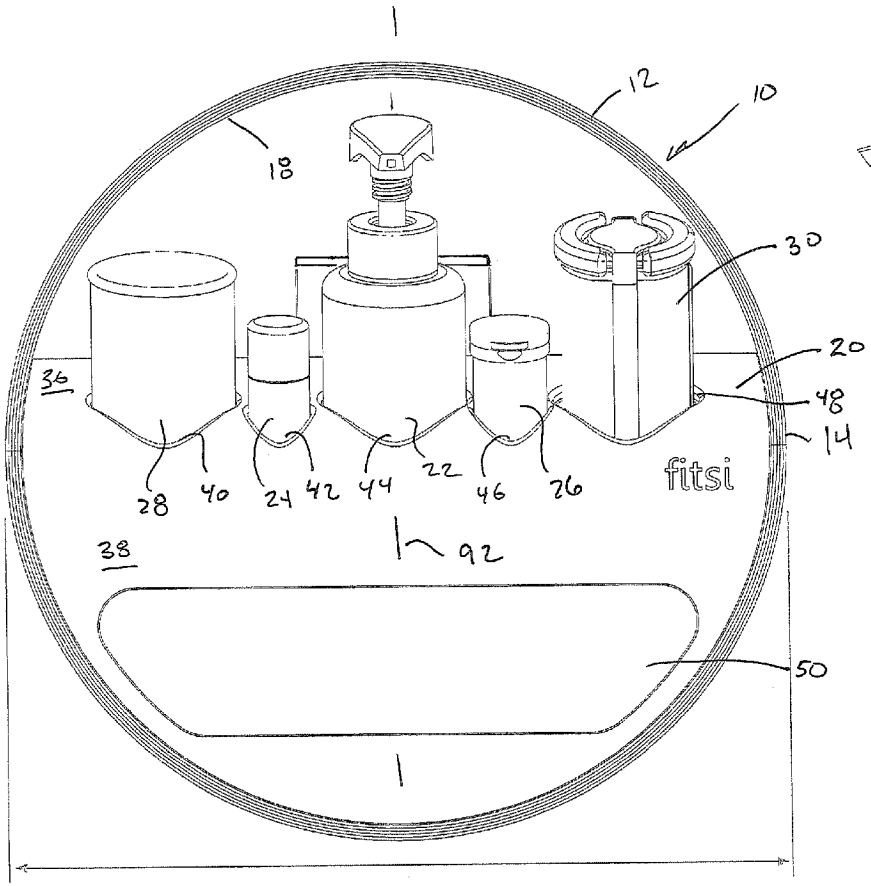
FIG. 1 is a front plan view of a first presently preferred embodiment of the present invention.
Figure 3:
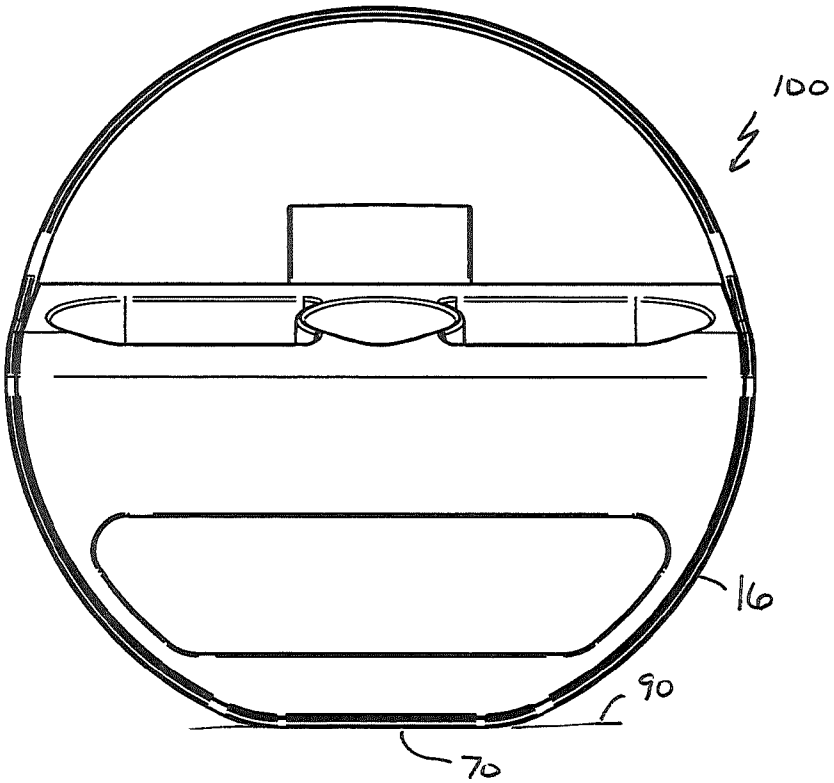
FIG. 3 is a front plan view of a first alternatively preferred embodiment of the present invention.

FIG. 1 shows a caddy 10 of a presently preferred embodiment of the invention. Specifically, a housing 12 provides a circular cross section or perimeter 14 for many embodiments, or a substantially circular cross section or perimeter 16 (as shown in FIG. 3 for a first preferred embodiment as will be explained in detail below).

The housing 12 preferably provides at least a substantially semi-circular handle 18 above a carriage 20 which is preferably utilized to hold such items as one or more pump dispensers 22 which could be used to hold hand sanitizer (if not provided in an another style container) and/or lotion, etc. lip balm 24, container 26, glass 28, toothbrush/toothpaste holder (s) 30, exercise bands, and/or provide general storage such as for glasses, mobile phones, etc.

The handle 18 may transition into the carriage 20 such as is shown in the figures, but for many embodiments, the width 32 of the handle 18 is preferably no more than about half of the width 34 of the carriage.

Carriage 20 is shown having a top face 36 and a front face 38. The top has vertically accessible compartments 40, 42, 44, 46, 48 illustrated with other embodiments possibly having more or fewer and/or with different configurations as at least one vertically accessible compartment (40-48). The front face 38 preferably provides at least one horizontally accessible compartments 50 which is illustrated as being perpendicularly oriented relative to the vertically accessible compartments 40-48 with the vertically accessible compartments 40-48 being located above the horizontally accessible compartment(s) 50. Also, for at least many of the preferred embodiments, the vertically accessible compartments 40-48 as well as the horizontally accessible compartment(s) 50 are symmetrically disposed about a center line 92 of the housing 12.

Figure 2:
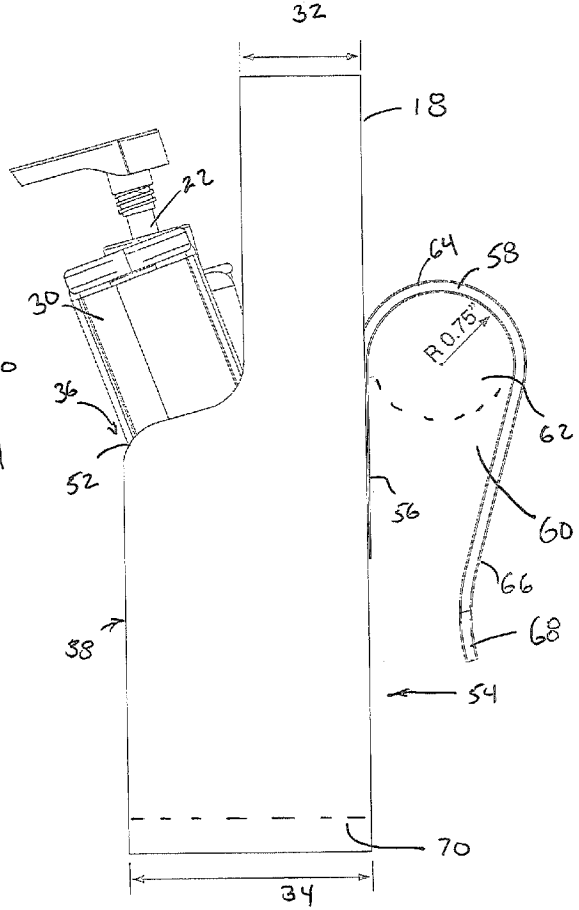
FIG. 2 is a side plan view of the first presently preferred embodiment of the present invention while also showing a first alternatively preferred embodiment in phantom.

From FIG. 2, one can see that for at least some embodiments, the vertical accessible compartments 40-48 does not necessarily preclude insertion from an angle from above such as is shown with the pump dispenser 22 and the toothbrush/toothpaste holder(s) 30.

The housing 18 is preferably a rigid material such as a plastic which could be injection formed, vacuum formed or otherwise provided. The carriage 20 may be a similar or different rigid material, preferably for many embodiments with a different color scheme than the housing 18. In the preferred embodiment, the housing 12 surrounds, supports, and/or even encircles the carriage.

The carriage 20 preferably bends at bend 52 to transition from the top face 36 to the front face 38. Housing 18 may provide this similar shape as shown in FIG. 2.

At a back 54 of the carriage 20 or housing 12 a connector 58 is preferably rotatably connected at a pivot 56. The connector 58 provides at least a slot 60 for receiving a hospital bed rail 62 therein. The connector 58 illustrated is a clip providing a the slot at elbow 64 which extends on to arm 66 and hand which bends away from arm 64 to allow one, such as a patient or hospital personnel, to press the clip onto the rail 62.

Figure 4:
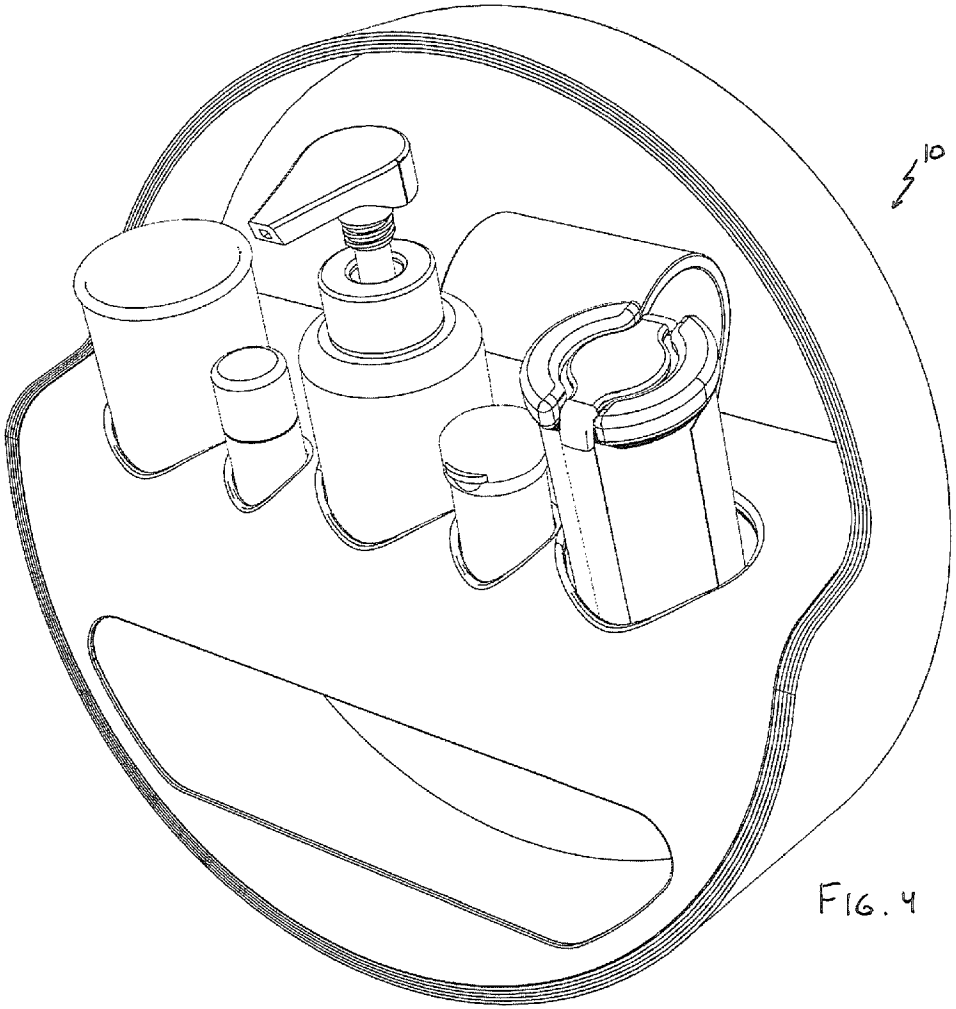
FIG. 4 is a front perspective view of the embodiment of FIG. 1.
Figure 7:
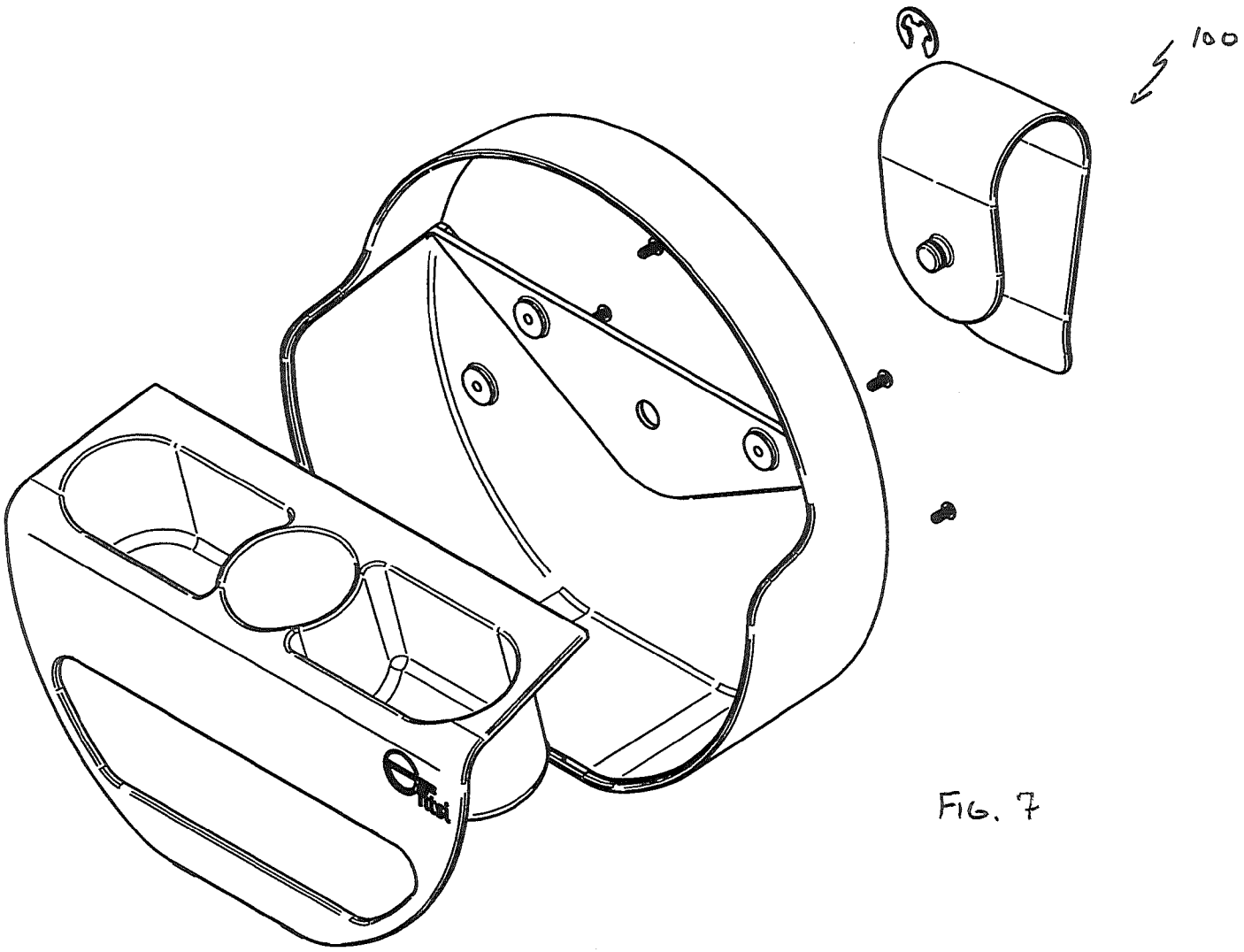
FIG. 7 is an exploded view of the embodiment of FIG. 3.

FIG. 2 also shows optional flat 70 which is better shown in FIG. 3. Flat 70 provides a planar surface onto which the caddy 100 can sit (without being connected to a rail 62) in a horizontal position/configuration. Flat 70 need not be provided for all embodiments as can be seen with reference to FIGS. 1 and 4. FIGS. 3 and 7 show the construction of a first alternatively preferred embodiment 100.

Figure 5:
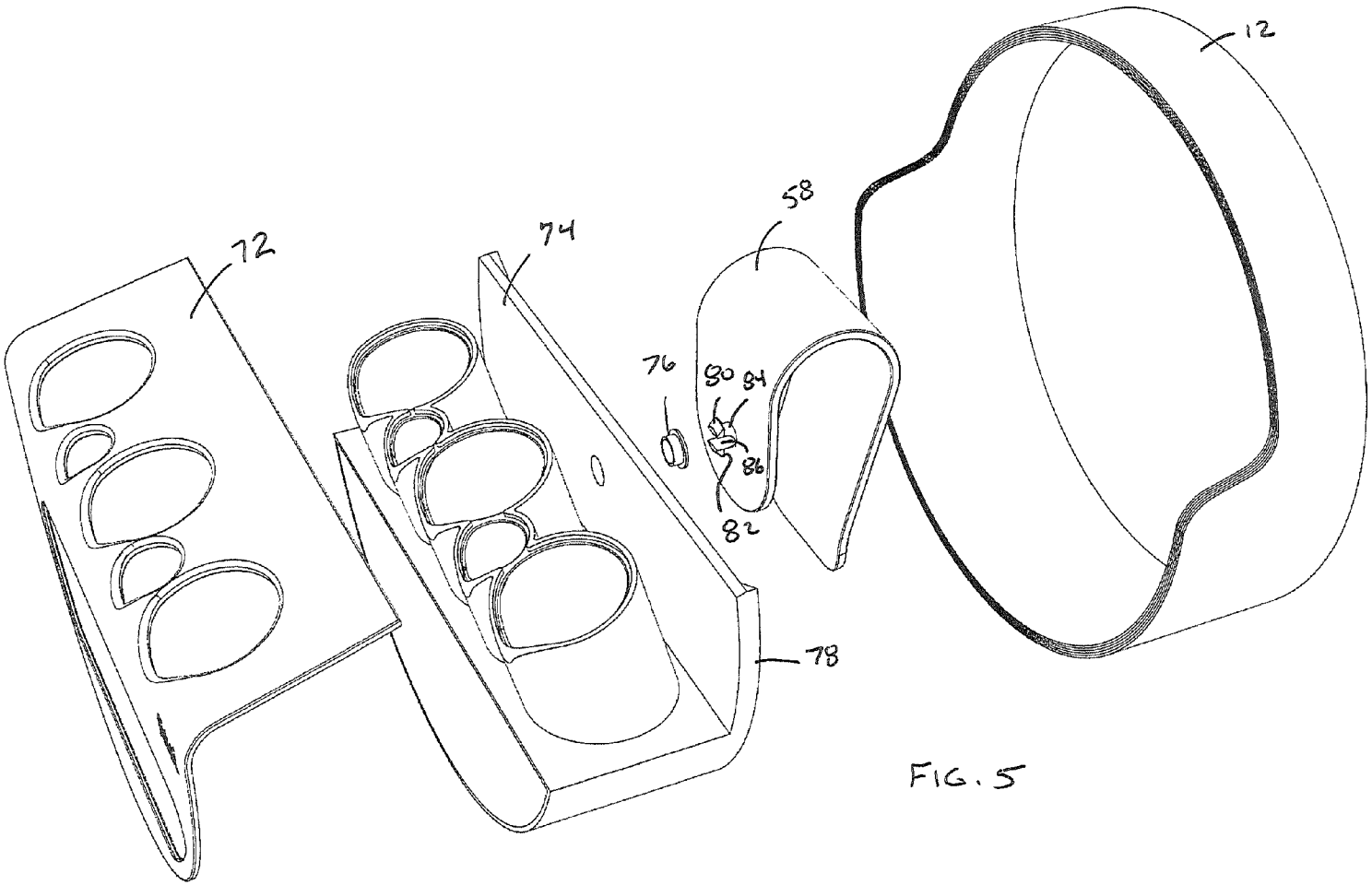
FIG. 5 is an exploded view of the embodiments of FIGS. 1-2 and 4.

FIG. 5 shows an exploded view showing the housing 12 separated from the carriage 20. The carriage may be multipiece such as with cover 72 covering base 74 which provides much of the compartments therein with the cover 72 providing the aesthetics. Of course, other embodiments could be constructed differently. FIG. 5 also shows the connection of the connector 58 connecting at a bushing 76 to provide a pivot at the carriage 20 (the bushing 76 effectively serves as a nut and would for this embodiment, be on the other side of wall 78 to receive shoulders 80,82 on posts 84,86 as would be understood by those of ordinary skill in the art. This embodiment just provides one way to provide a pivot 56. Other embodiments may provide the pivot differently.

Figure 6:
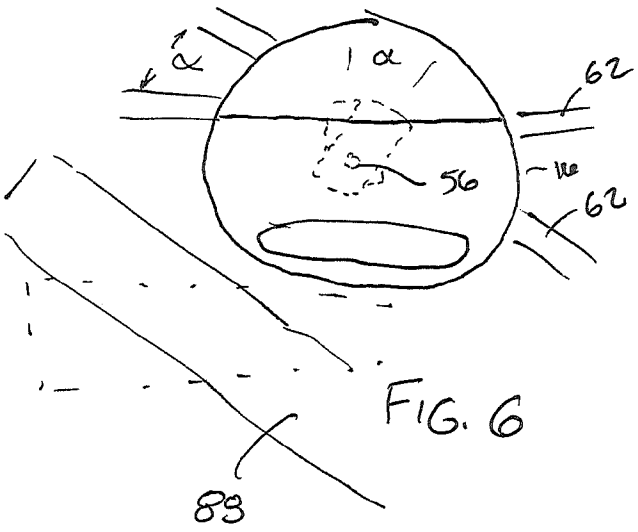
FIG. 6 is a front schematic view of the embodiment of FIGS. 1-2 and 4-5 in use.

By providing pivot 56, as the angle of the rail 62 changes, such as normally occurs when the rail 62 is raised/lowered with one portion of a hospital bed 88 relative to another as is shown in FIG. 6, then an angle alpha is created whereby the angle alpha is the angle relative to horizontal (as shown in FIG. 1). The pivot similarly rotates relative to the position shown in Figure by the same angle alpha to maintain the horizontal configuration as shown in FIG. 6. This is referred to by the applicant as self-leveling. The patient need not make the rotation for many embodiments, but instead, gravity acting on the carriage 20, the housing 12 and/or the components in the caddy preferably provide the rotation as the angle alpha is changed. Thus, the caddy 10 with its pivot 58 maintains the housing 18 at a predetermined position relative to the horizontal surface 90 as shown in FIG. 3.

As shown in FIG. 6 in phantom, the pivot 56 is at a center portion of the housing perimeter 16, but could be at other locations such as connected to either the housing 12 and/or carriage 20 for other embodiments at various locations.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

What is claimed is:

1. A self-leveling caddy in combination with a hospital vertically extending bed rail, said combination comprising:

a rigid housing having a substantially round perimeter, said housing supporting a carriage having a plurality of compartments;

a connector connected to the housing, said connector having a slot receiving a hospital bed rail therein; and wherein said connector is connected at a rearwardly extending pivot to at least one of the housing and the carriage, whereby as the hospital bed rail is angled relative to a horizontal surface at an angle, alpha, the pivot rotates at the angle, alpha to maintain the housing at a predetermined position of the caddy relative to the horizontal surface, said pivot extending perpendicularly and rearwardly relative to the substantially round perimeter of the housing.

2. The self-leveling caddy of claim 1 wherein the pivot is at a back of the carriage.

3. The self-leveling caddy of claim 2 wherein round cross section and the pivot is at a center of the housing perimeter.

4. The self-leveling caddy of claim 3 wherein the housing provides a substantially semicircular handle above and over the carriage.

5. The self-leveling caddy of claim 4 wherein the carriage has at least one vertically accessible compartment.

6. The self-leveling caddy of claim 5 wherein the carriage has at least one horizontally accessible compartment.

7. The self-leveling caddy of claim 6 wherein the at least one horizontally accessible compartment is located on a front of the carriage.

8. The self-leveling caddy of claim 6 wherein the carriage has a front face connected to a top face providing the at least one vertically accessible compartment above the at least one horizontally connected compartment.

9. The self-leveling caddy of claim 1 wherein the at least one vertically accessible compartment is symmetrically disposed relative to the pivot.

10. The self-leveling caddy of claim 1 wherein the bottom of the housing provides a flat, said flat providing a rest for supporting the housing in a horizontal relationship when placed on the flat.

11. The self-leveling caddy of claim 1 wherein the housing provides a handle with a width of no more than half a width of the carriage.

12. A caddy comprising:

a rigid housing having at least a substantially round vertically extending perimeter with a substantially semi-circular handle extending vertically above and over a carriage turning a portion of the housing;

the carriage surrounded vertically by the housing and having at least one vertically accessible compartment internal to the housing.

13. The caddy of claim 12 wherein the carriage has at least one horizontally accessible compartment.

14. The caddy of claim 13 wherein the carriage has a front face connected to a top face providing the at least one vertically accessible compartment above the at least one horizontally connected compartment.

15. The caddy of claim 14 wherein the bottom of the housing provides a flat, said flat providing a rest for supporting the housing in a horizontal relationship when placed on the flat.

16. The caddy of claim 14 further comprising a pivot connecting a connector to the housing, said connector provides a slot for receiving a hospital bed rail therein; and whereby as the hospital bed rail is angled relative to a horizontal surface at an angle, alpha, the pivot rotates with the angle, alpha to maintain the housing at a predetermined position relative to the horizontal surface, said pivot extending perpendicularly to a vertically extended perimeter of the housing.

17. The caddy of claim 16 wherein the pivot is located at a back of the housing.

18. The caddy of claim 17 wherein the pivot is centrally located relative to the housing.

19. The caddy of claim 12 wherein the housing provides a handle with a width of no more than half a width of the carriage.

* * * * *